United States Patent [19]

Takeshita

[11] Patent Number: 4,763,411

[45] Date of Patent: Aug. 16, 1988

[54] PROCESS FOR PRODUCING A WIRE STRAND WITH A TERMINAL

[75] Inventor: Kazutoshi Takeshita, Shizuoka, Japan

[73] Assignee: Yazaki Corporation, Tokyo, Japan

[21] Appl. No.: 19,844

[22] Filed: Feb. 27, 1987

[51] Int. Cl.[4] ..... H01R 43/04

[52] U.S. Cl. ..... 29/863; 29/748; 81/9.51

[58] Field of Search ..... 29/861, 863, 748, 33 M, 29/867

[56] References Cited

U.S. PATENT DOCUMENTS

| | | | |
|---|---|---|---|
| 3,857,306 | 12/1974 | Gudmestad | 81/9.51 |
| 4,126,936 | 11/1978 | Koller | 29/863 |
| 4,347,651 | 9/1982 | Inoue et al. | 29/748 X |
| 4,470,181 | 9/1984 | Sergeant | 29/748 X |

FOREIGN PATENT DOCUMENTS

| | | | |
|---|---|---|---|
| 73569 | 6/1970 | Fed. Rep. of Germany . | |
| 141590 | 5/1980 | Fed. Rep. of Germany | 29/861 |
| 1150913 | 6/1969 | United Kingdom . | |

*Primary Examiner*—Timothy V. Eley
*Assistant Examiner*—C. J. Arbes
*Attorney, Agent, or Firm*—Armstrong, Nikaido, Marmelstein & Kubovcik

[57] ABSTRACT

A process of and an apparatus for producing a wire strand with a terminal which can reduce the number of types of wires used for production of wire harnesses and wherein a load to a controller in a wire processing apparatus can be reduced and software for processing can be changed easily. In the process and apparatus of the invention, data of designated matters providing information necessary for connection of a terminal to a wire string such as an application, a type and/or a processing procedure of the wire string are printed at portions of a wire on opposite sides of a position of the wire at which the wire is to be cut after the wire has been fed by metering, whereby the wire is thereafter subject to the successive necessary processings such as cutting and stripping of and connection of a terminal to the wire in accordance with the information printed on the wire.

1 Claim, 3 Drawing Sheets

PROCESS FOR PRODUCING A WIRE STRAND WITH A TERMINAL

BACKGROUND OF THE INVENTION

This invention relates to a process of and an apparatus for producing a wire strand with a terminal.

Conventionally, a wire harness (wire assembly) used for wiring of an automobile or a like vehicle includes wire strands on which indications are provided to indicate applications and/or functions (such as, for example, applicable loads, systems and current capacities) of the wire strands. A wire harness such as, for example, a wire harness 5 shown in FIG. 4 is composed of several wire strands such as, for example, wire strands shown in FIGS. 3*a*, 3*b* and 3*c*. The wire strands 4, 4', 4'' shown in FIGS. 3*a*, 3*b* and 3*c*, respectively, have different indications including, singly or in combination, a straight line 1, a spiral line 2 and a chain line 3 which may be of different colors from each other and/or from a basic color or colors of the wires 4, 4', 4''.

Accordingly, in producing such wire strands $6_1$, $6_2$, . . . , $6_5$ as shown in FIG. 5 which make various elements of a wire harness, various types of wires which are different in color, diameter and so on are prepared in advance, and in a process of producing a wire harness, wire strands with terminals are produced from such prepared wires by means of an automatic wire processing apparatus which performs, in combination, metering, cutting and stripping of, connection of terminals to, and assembly to housings of the prepared wires of such various types, and then the wire strands with terminals thus produced are bundled for individual circuits to thus form a sub harness or a main harness.

The prior art described above has following problems:

(1) For example, 300 to 400 different types of wires of different colors must be produced and managed for a single automobile.

(2) Because wire strands of a same type are produced on an automatic processing apparatus in accordance with data stored in advance in a control unit regarding stripping of an insulator coating, presence or absence of a terminal, a type of such terminal and so on, whenever wires of a different type are to be produced subsequently, software for processing must be changed, which will result in increase in load to storage capacity in a control system.

(3) Where a wire strand with a terminal is automatically fitted and assembled to a housing at a last stage of an automatic processing apparatus, the wire processing operation is further complicated by the step.

SUMMARY OF THE INVENTION

The present invention has been made to resolve the problems described above, and it is an object of the invention to provide a process of and an apparatus for producing a wire strand with a terminal which can reduce the number of types of wires used for production of wire harnesses and wherein a load to a controller in a wire processing apparatus can be reduced and software for processing can be changed easily.

According to an aspect of the present invention, there is provided a process of producing a wire string with a terminal wherein a wire is first fed by a particular length by metering and cut into a string of the particular length, and then the wire string is stripped at one or both of opposite end portions thereof, whereafter a terminal is connected to each of the stripped end portion or portions of the wire string, the process comprising a step of printing, at portions of a wire on opposite sides of a position of the wire at which the wire is to be cut after the wire has been fed by metering, data of designated matters providing information necessary for connection of a terminal to a wire string such as an application, a type and/or a processing procedure of the wire string, whereby the wire is thereafter subject to the successive necessary processings such as cutting and stripping of and connection of a terminal to the wire in accordance with the information printed on the wire.

According to another aspect of the invention, there is provided an apparatus for producing a wire string with a terminal, comprising a wire feeding and cutting device for metering and cutting a particular length of a wire supplied thereto into a string, a wire gripping and transporting device mounted for intermittent movement with gripping at least one end of the wire string, a wire stripping device located along a direction of movement of said gripping and transporting device for stripping the wire string along an end portion of a predetermined length, one or more terminal connecting devices each for connecting a terminal of a specific type to the stripped end portion of a wire string, a printing device located above a cutting blade of said wire feeding and cutting device for printing data of designated matters in the form of characters, graphic patterns or the like providing information necessary for connection of a terminal to a wire string such as an application, a type and/or a processing procedure of the wire string, and a sensor provided for each of said wire feeding and cutting device and said terminal cutting device or devices for reading the printed data of the designated matters, whereby said wire feeding and cutting device, said wire stripping device and said terminal connecting device or devices are each caused to operate in accordance with information read by the associated sensor so that the wire is subject to the successive necessary processings such as cutting and stripping of and connection of a terminal to the wire.

According to the present invention, various types of wire strands with terminals can be produced from an elongated strand (wire) of a same type by changing data of the designated matters to be printed on opposite end portions of a wire strand to arbitrarily designate or change a type of a terminal to be connected to the wire strand, a specification of stripping of the wire string necessary for connection of a terminal of the specified type, a specification of assembly of a housing to the terminal of the wire strand, and so on. Accordingly, all the problems of the prior art described above are resolved by the invention.

DESCRIPTION OF THE PREFERRED EMBODIMENTS

Now, the present invention will be described in detail with reference to the accompanying drawings in which a preferred embodiment is shown.

Figure 1A:
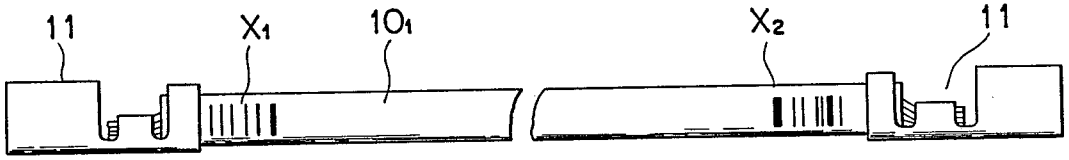
FIGS. 1*a*, 1*b* and 1*c* are schematic illustrations showing exemplary wires which may be produced using a process and/or an apparatus according to the present invention.
Figure 1B:
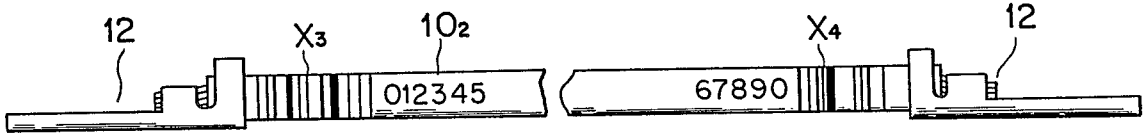
Figure 1C:
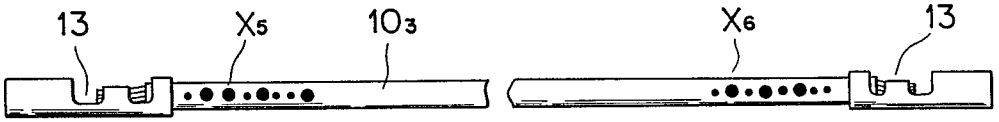

Referring first to FIGS. 1*a* to 1*c*, there are shown different types of wire strands with terminals. The wire strands with terminals shown in FIGS. 1*a* to 1*c* include each a strand $10_1$, $10_2$ or $10_3$, respectively, which makes an element of a harness. Marks of data $X_1$ and $X_2$, $X_3$ and $X_4$, and $X_5$ and $X_6$ indicating types and applications of the wire strands, working (processing) procedures and so on are printed at portions adjacent opposite ends of the strands $10_1$, $10_2$ and $10_3$, respectively, and terminals 11, 12 and 13 of different types are connected to opposite ends of the strands $10_1$, $10_2$ and $10_3$ in accordance with the data of the printed marks on the latter, respectively.

In order to print such marks on a strand of a wire, one of various techniques including techniques of jetting ink using an ultrasonic oscillator, normal imprinting, and normal printing such as pressure sensitive printing may be selectively used. Such printed marks may be coded bars $X_1$, $X_2$ as shown in FIG. 1*a*, a combination of coded bars and numerals $X_3$, $X_4$ as shown in FIG. 1*b*, or coded dots as shown in FIG. 1*c*, applied to outer circumferential portions adjacent opposite ends of the strand $10_1$, $10_2$ or $10_3$, respectively. Various combinations of graphic patterns, numerals and the like may be available for such printed marks, but, for example, coded bars such as the coded bars $X_1$, $X_2$ of FIG. 1*a* are conveniently used to designate a processing procedure of a strand which will be hereinafter described while numerals are conveniently used to designate a housing and/or a mounting hole where a terminal is assembled to a housing by manual operation.

Figure 2:
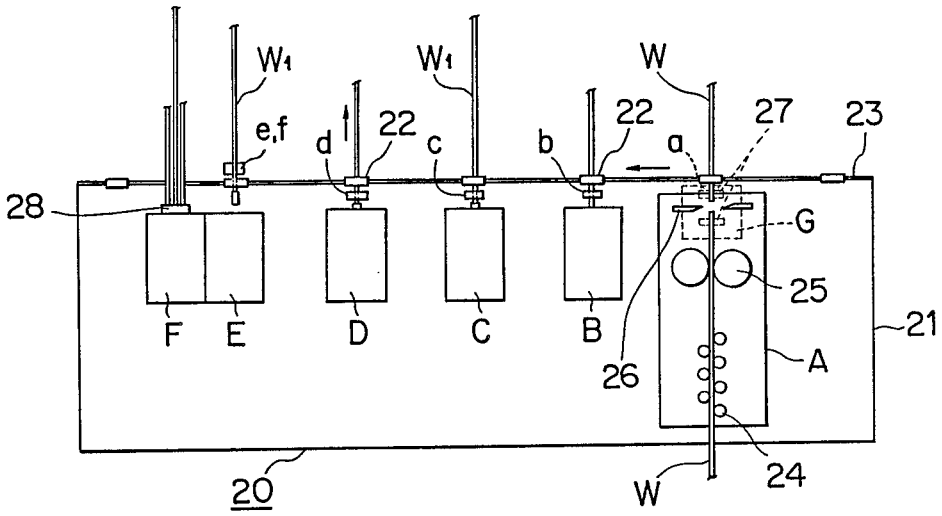
FIG. 2 is a plan view showing an apparatus according to an embodiment of the present invention.
Figure 3A:
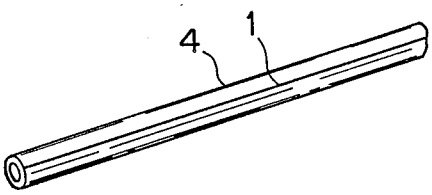
FIGS. 3*a*, 3*b* and 3*c* are schematic illustrations showing exemplary wires which are used to produce a conventional wire harness.
Figure 3B:
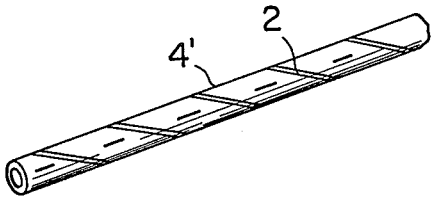
Figure 3C:
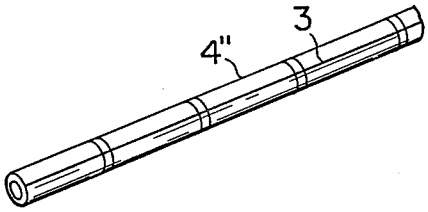
Figure 4:
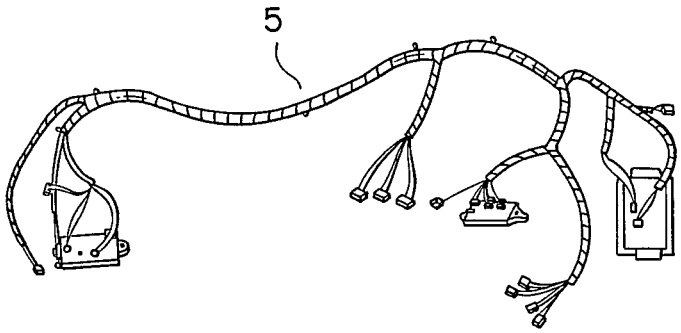
FIG. 4 is a schematic illustration showing a typical one of conventional wire harnesses.
Figure 5:
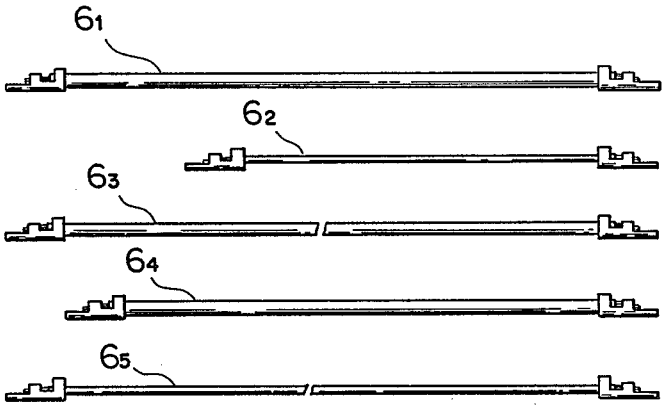
FIG. 5 is a schematic illustration showing several conventional wires with terminals which may be used to produce the wire harness of FIG. 4.

Referring now to FIG. 2, there is shown, in plan, an apparatus for producing a wire string with a terminal according to an embodiment of the present invention.

An automatic terminal assembling apparatus 20 for assembling a terminal to a wire string includes a common work bench 21, and a wire gripping and transporting device 23 located for intermittent movement along a longitudinal side edge of the work bench 21 and having a plurality of grippers 22 each including a pair of clamps.

A device A for feeding and cutting a wire W is mounted on the work bench 21 and includes a plurality of wire reforming and feeding rolls 24, a pair of metering and feeding rolls 25, a pair of cutting blades 26, and so on. A printing device G is mounted for up and down movement above the cutting blades 26. The printing device G includes a pair of print heads 27 located on opposite front and rear sides of the cutting blades 26 such that the cutting blades 26 are located between the print heads 27.

Also mounted on the work bench 21 are a wire stripping device B for determining a length of and stripping a coating from an end portion of a wire string at which a terminal is to be fastened to the wire string, that is, along which the coating of the wire is to be removed, three terminal connecting devices C, D, E for connecting terminals of different types to wire strands by a suitable means such as stamping or pressure welding, and a device F for automatically assembling a housing to a wire string.

The devices A, B, C and D each include a sensor a, b, c or d, respectively, for reading data printed on a wire or wire strand while the device E includes a pair of sensors e, f for reading data on a wire string regarding connection of a terminal and assembly of a housing. The devices A to G are all connected to a controlling device not shown for receiving information read by the sensors a to f to control the devices A to G.

Now, operation of the apparatus shown in FIG. 2 will be described.

At first, in accordance with an instruction derived from information stored in the controlling device, the wire reforming and feeding rolls 24 and the metering and feeding rolls 25 operate to meter and feed a predetermined length of a wire, and then the wire is fixed by the metering and feeding rolls 25 and a gripping device 22.

Subsequently, the printing device G is moved down and prints marks of designated matters such as a type and an application of a wire string to be produced and a processing procedure, for example, as shown at $X_1$ to $X_6$ in FIGS. 1*a* to 1*c*. After then, the printing device G is moved up back to its predetermined home position. Such marks are printed on two portions of the wire on the front and rear sides of the cutting blades 26 by the two print heads 27.

The printed marks such as characters or graphic patterns are then read by the sensor a of the wire feeding and cutting device A. Then the cutting blades 26 are caused to operate to cut the wire W into a string in accordance with information of the marks thus read, and then the wire gripping and transporting device operates to transport the wire string $W_1$ of the predetermined length to the next wire stripping device B. Simultaneously, the wire W is fed by a predetermined length for next work to the wire feeding and cutting device A. It is to be noted here that the wire W already has printed marks at the leading end portion thereof because the marks have been printed before the wire string $W_1$ is cut from the wire W. In case no mark has been printed or printed marks are not clear, the sensor a cannot obtain necessary information, and accordingly the cutting blades 26 will not operate.

It is to be noted here that such marks may otherwise be printed only after a wire has been cut and that the printing station need not be located adjacent the cutting station and may be provided separately for a subsequent next step.

At the wire stripping device A to which the wire string $W_1$ has been transported, the printed marks on the wire string $W_1$ are first read by the sensor b, and a type of a terminal to be fastened to the wire string $W_1$ is determined from information of the printed marks thus read. And then, the wire string $W_1$ is stripped, that is, the coating of the wire string $W_1$ is removed, by a length required to fasten a terminal of the type thus determined to the wire string $W_1$. Thereafter, the wire string $W_1$ is transported to the terminal connecting device C.

At the terminal connecting device C, the printed information on the wire string $W_1$ is first read similarly by the sensor c in order to determine whether or not a terminal of a specific type available on the terminal connecting device C is to be connected to the wire string $W_1$. In case the determination is affirmative, the terminal connecting device C is rendered operative, but on the contrary in case the determination is negative, the wire string $W_1$ is transported to the next terminal connecting device D and then to E without being processed by the terminal connecting device C. Thus, a terminal of a type specified by the printed information on the wire string $W_1$ is fastened or connected to the wire string $W_1$ by one of the three terminal connecting devices C to E.

The additional sensor f of the last terminal connecting device E is provided to read the printed information on the wire string $W_1$ in order to determine from the information whether or not a terminal connected to the wire string $W_1$ is to be automatically fitted and assembled to a housing and at which position of a housing an insertion hole for the terminal is located. In case it is determined that the terminal is to be automatically fitted and assembled to a housing, the automatic assembling device F is rendered operative when the wire string $W_1$ is transported thereto so that the terminal of the wire string $W_1$ is inserted into and secured to a specified mounting hole of a housing 28 of a predetermined type. However, in case the determination is contrary, the automatic assembling device F will not operate and accordingly the wire string $W_1$ to which the terminal has been connected is then transported to a station for a subsequent next step at which the gripping device 22 is opened to release the wire string $W_1$. It is to be noted here that terminals can be connected to opposite ends of a wire string if a wire left after cutting at the feeding and cutting device A is bent over into the shape of a loop, if necessary, at the next feeding step and then the bent end is gripped by another gripping device 22 to allow the bent end of the wire string to be processed in a similar manner as described above.

In this manner, steps of cutting a wire, stripping a string of a wire thus cut, connecting a terminal to the wire string and assembling the wire string to a housing are processed in accordance with information such as characters and graphic patterns printed on one or both of opposite end portions of the wire string.

The length of a wire to be metered and cut by the wire feeding and cutting device A and information such as characters and graphic marks to be printed by the printing device G can be stored in prior in the form of a program in the controlling device described above. In this instance, various combinations of the length and such information may be allowed. Accordingly, wires with terminals of various types wherein the overall length, a terminal connected, and so on are different can be produced from a wire of a single type.

It is to be noted that while in the embodiment described above the steps of cutting and stripping a wire, connecting a terminal to the wire, and assembling the wire to a housing are carried out successively on the common work bench 21 in response to information printed on the wire, it is alternatively possible to temporarily keep in custody or convey to another place a wire strand after information has been printed and to separately or successively carry out the following steps including stripping and connection of a terminal at such a different place.

Since the present invention has such a construction as described above, it presents following effects:

(1) The number of types of necessary wire strings (different in color, type of an insulator, application and so on) produced or used for production of a wire harness can be minimized.

(2) Due to presence of data of the designated matters in the form of characters, graphic patterns or the like printed at opposite end portions of a wire string, the wire string itself serves a source of information regarding a processing procedure, kinds of processing operations to be done and so on. Accordingly, flows of articles and information are unified, which facilitates management of the articles.

(3) Since information necessary for processing of a wire or wire string such as stripping of, connection of a terminal to and assembly of a housing to a wire string can be derived almost from the wire itself, a load to storage capacity of a controlling device can be reduced, which will further facilitate automation of such processing.

(4) Due to the effects listed above, the number of man-hour necessary for production of a wire harness can be reduced and hence the cost can be reduced significantly.

What is claimed is:

1. The process of producing a wire string, which comprises:

(a) affixing to a wire coming from a source of supply, predetermined data concerning the wire string to be made therefrom;

(b) cutting the wire according to the data;

(c) conveying the cut wire in accordance with its one end through a plurality of successive stations in a line; and (d) sequentially sensing and processing said wire at the one end according to the selected data thereon, read out by a sensor provided at each successive station to provide a finished wire string ready for subsequent use.

* * * * *